US009000312B2

(12) United States Patent
Shen et al.

(10) Patent No.: US 9,000,312 B2
(45) Date of Patent: Apr. 7, 2015

(54) WATERPROOF KEYBOARD

(71) Applicants: Lite-On Electronics (Guangzhou) Limited, Guangzhou (CN); Lite-On Technology Corporation, Taipei (TW)

(72) Inventors: Hai-Nan Shen, Dong Guan (CN); Shan-Yu Lu, Zhao Qing (CN)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 270 days.

(21) Appl. No.: 13/632,071

(22) Filed: Sep. 30, 2012

(65) Prior Publication Data

US 2013/0313094 A1 Nov. 28, 2013

(30) Foreign Application Priority Data

May 25, 2012 (CN) ..... 2012 1 0164850

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/06*** | (2006.01) |
| ***H01H 13/86*** | (2006.01) |

(52) U.S. Cl.

CPC ..... *H01H 13/06* (2013.01); *H01H 13/86* (2013.01); *H01H 2215/004* (2013.01); *H01H 2215/008* (2013.01); *H01H 2223/002* (2013.01); *H01H 2223/034* (2013.01); *H01H 2227/026* (2013.01)

(58) Field of Classification Search

CPC ..... H01H 13/76; H01H 9/26; H01H 13/72; H01H 9/00; H03K 17/975; H05K 7/00

USPC .... 200/5 R, 5 B–5 E, 600, 46, 345, 341, 333, 200/5 A, 310

See application file for complete search history.

(56) References Cited

U.S. PATENT DOCUMENTS

| | | | | |
|---|---|---|---|---|
| 5,810,491 | A | 9/1998 | Muller | |
| 7,723,631 | B2 * | 5/2010 | Purcocks | 200/345 |
| 2007/0199804 | A1 * | 8/2007 | Joseph et al. | 200/5 A |
| 2013/0098743 | A1 * | 4/2013 | Kuo | 200/5 A |

* cited by examiner

*Primary Examiner* — Edwin A. Leon
*Assistant Examiner* — Anthony R. Jimenez
(74) *Attorney, Agent, or Firm* — Li & Cai Intellectual Property (USA) Office

(57) ABSTRACT

A waterproof keyboard includes a lower housing, a circuit membrane disposed on the lower housing, a pressure plate disposed on the circuit membrane, an elastomer member, an upper housing disposed on the elastomer member and a plurality of key caps disposed on the upper housing. The pressure plate has a main body formed with a plurality of openings and ridges. The elastomer member has a plurality of switch domes disposed in the openings correspondingly, a base layer disposed on the main body, and a plurality of raised portions disposed on the ridges respectively. The ridges of the pressure plate presses tightly to the underside of the raised portions. The pressure plate is constructed to evenly support the elastomer member.

17 Claims, 6 Drawing Sheets

WATERPROOF KEYBOARD

BACKGROUND OF THE INVENTION

1. Field of the Invention

The present invention is related to a waterproof keyboard. In particular, to a keyboard having switch domes, which have waterproof structures to prevent liquid from intruding the electrical equipment, to avoid damaging the interior components of the electrical devices.

2. Description of Related Art

Waterproof keyboards are designed to provide liquid-resist structure to seal gaps and spaces, so that the liquid does not enter the keyboard to prevent shorting the internal circuit, damaging the keyboard, and/or disabling the computer. A conventional waterproof keyboard is described in U.S. Pat. No. 5,810,491, titled "Splash Water Protected Keyboard". The disclosed keyboard utilized reinforcement ribs protruding downwardly from an upper housing against a rubber mat. Under the rubber mat, a switch foil and a bottom plate are arranged sequentially.

However, the water-resist effectiveness of the above conventional waterproof keyboard still can be improved. The use of reinforcement ribs alone in pressing against the rubber mat to block the liquid has limited effectiveness. Besides, the key mounts, which are used to guide the keys when pressed or depressed by the user, are arranged above the switch domes. When any liquid is accidentally splashed on the keyboard, the liquid can enter the keyboard via these key mounts and flow unrestrictedly along the rubber mat. Moreover, the keyboard lacks sufficient retaining structures around the switch domes. This deficiency adversely affects the touch feel of the user when depressing the keys.

Therefore, it is desirable to propose a novel waterproof keyboard to overcome the above-mentioned problems. The proposed waterproof keyboard not only has good waterproof capability, but also provides good touch feel when stroking the keys.

SUMMARY OF THE INVENTION

The present invention provides a waterproof keyboard having good waterproof function and insuring good touch feel when stroking the keys.

In order to achieve the above objectives, the waterproof keyboard of the present invention comprises a lower housing, a circuit membrane disposed on the lower housing, a pressure plate disposed on the circuit membrane, an elastomer member, an upper housing disposed on the elastomer member, and a plurality of key caps. The pressure plate includes a main body. A plurality of ridges protrudes upwardly from the main body forming a grid-like pattern. The main body is formed with a plurality of openings. The openings are surrounded and separated from each other by the ridges. The elastomer member includes a plurality of switch domes disposed in the respective openings, a base layer extends from the periphery of the switch domes at a predetermined distance from a bottom edge thereof, and a plurality of raised portions protrudes upwardly from the base layer forming a grid-like pattern. The base layer is disposed on the main body of the pressure plate. The raised portions are disposed on the respective ridges. The upper housing has a plurality of guiding tubes disposed on the elastomer member and connects to the lower housing. Each key cap has a key stem extending from the underside thereof. The key stems pass through the guiding tubes and abut the switch domes. The ridges of the pressure plate are abutted against the raised portions of the elastomer member, while the raised portions of the elastomer member and the ridges of the pressure plate are orderly arranged and fixed to the underside of the upper housing. The pressure plate forms a propping structure which evenly props up the elastomer member.

Thus, the instant disclosure has following advantages. The pressure plate acts as a propping structure which evenly props up the elastomer member. Together the pressure plate and the elastomer member work cooperatively with the upper housing to provide not only a good waterproof capability, but also good touch feel when stroking the keys.

For further understanding of the present invention, reference is made to the following detailed description illustrating the embodiments and examples of the present invention. The description is for illustrative purpose only and is not intended to limit the scope of the claims.

DETAILED DESCRIPTION OF THE PREFERRED EMBODIMENTS

Figure 1:
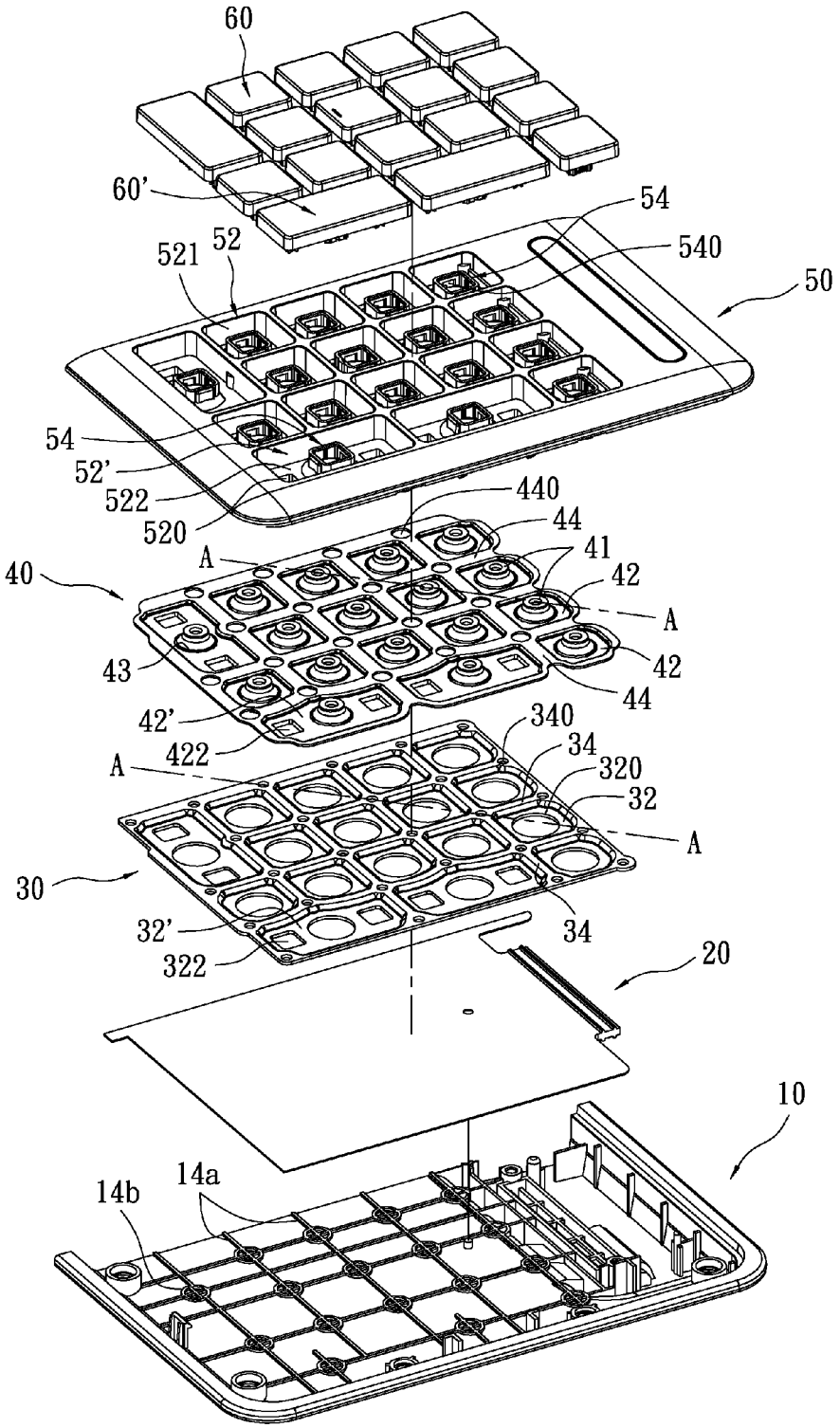
FIG. 1 is an exploded view of a waterproof keyboard of the present invention.
Figure 2:
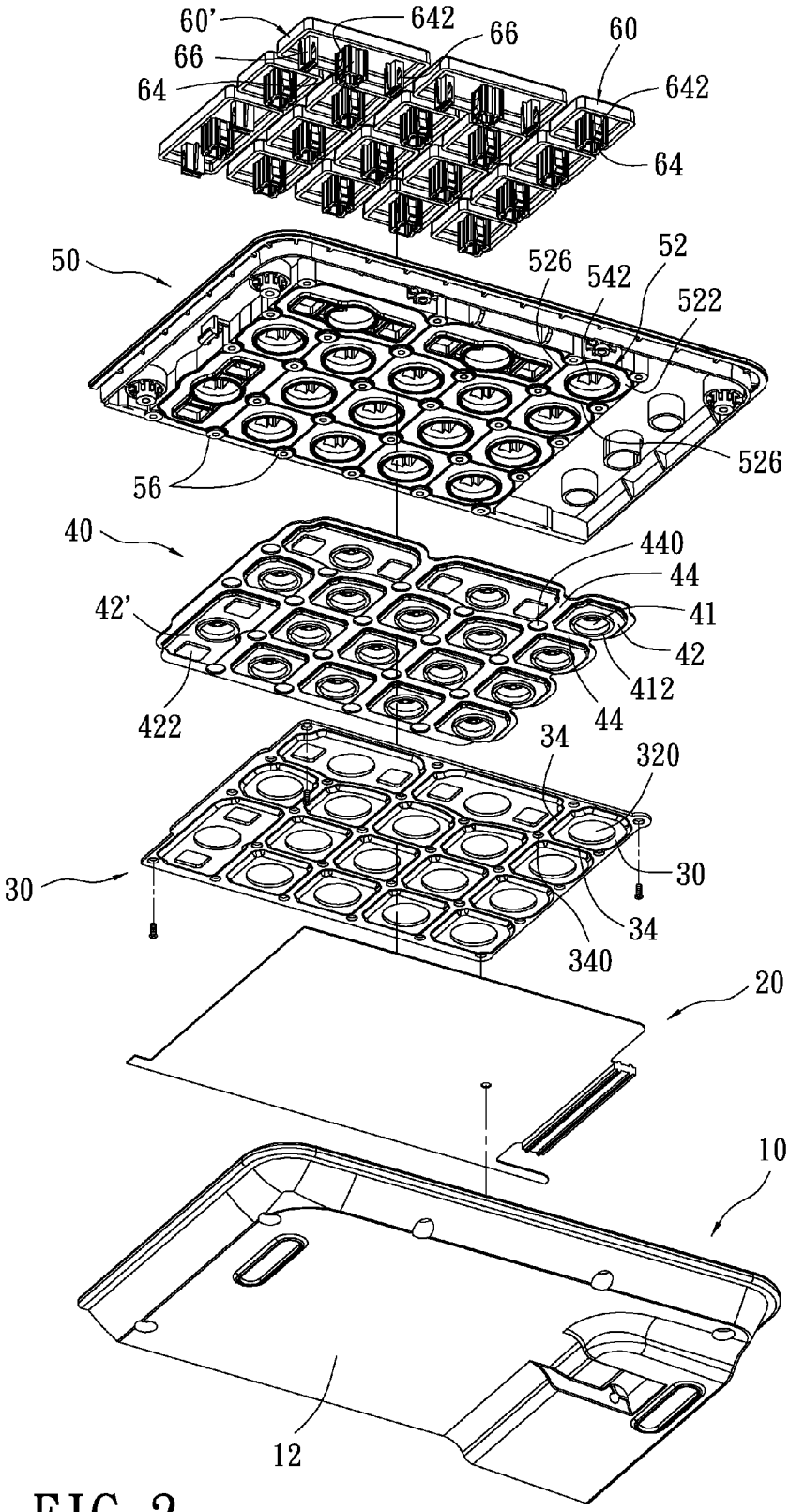
FIG. 2 is another exploded view of the waterproof keyboard of the present invention.
Figure 3:
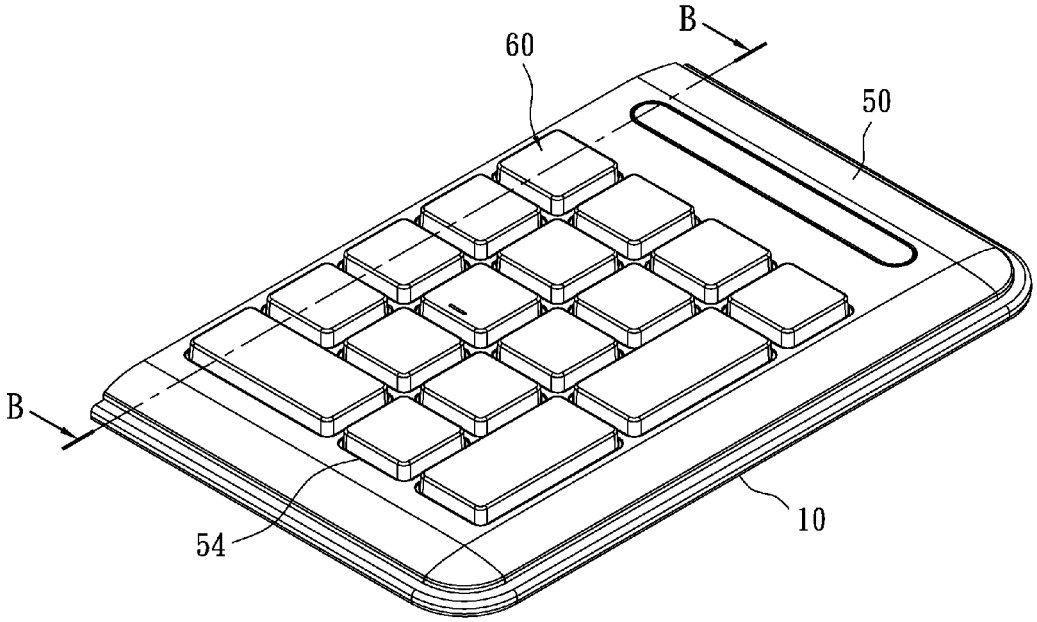
FIG. 3 is an assembled view of the waterproof keyboard of the present invention.

Please refer to FIGS. 1 and 2, which are different exploded views of a waterproof keyboard of the present invention. This embodiment is illustrated by the numeric keys for explaining purpose. It is to be noted the technical features of the present invention can be applied to the whole keyboard. The waterproof keyboard comprises a lower housing 10, a circuit membrane 20, a pressure plate 30, an elastomer member 40, an upper housing 50, and a plurality of key caps 60, 60'. The circuit membrane 20 is disposed on the lower housing 10. The pressure plate 30 is disposed on the circuit membrane 20. The elastomer member 40 is disposed on the pressure plate 30. The upper housing 50 is disposed on the elastomer member 40 and connected to the lower housing 10. Besides, the key caps 60, 60' are arranged on the upper housing 50. Whereas an assembled view of the waterproof keyboard is shown in FIG. 3.

Figure 1A:
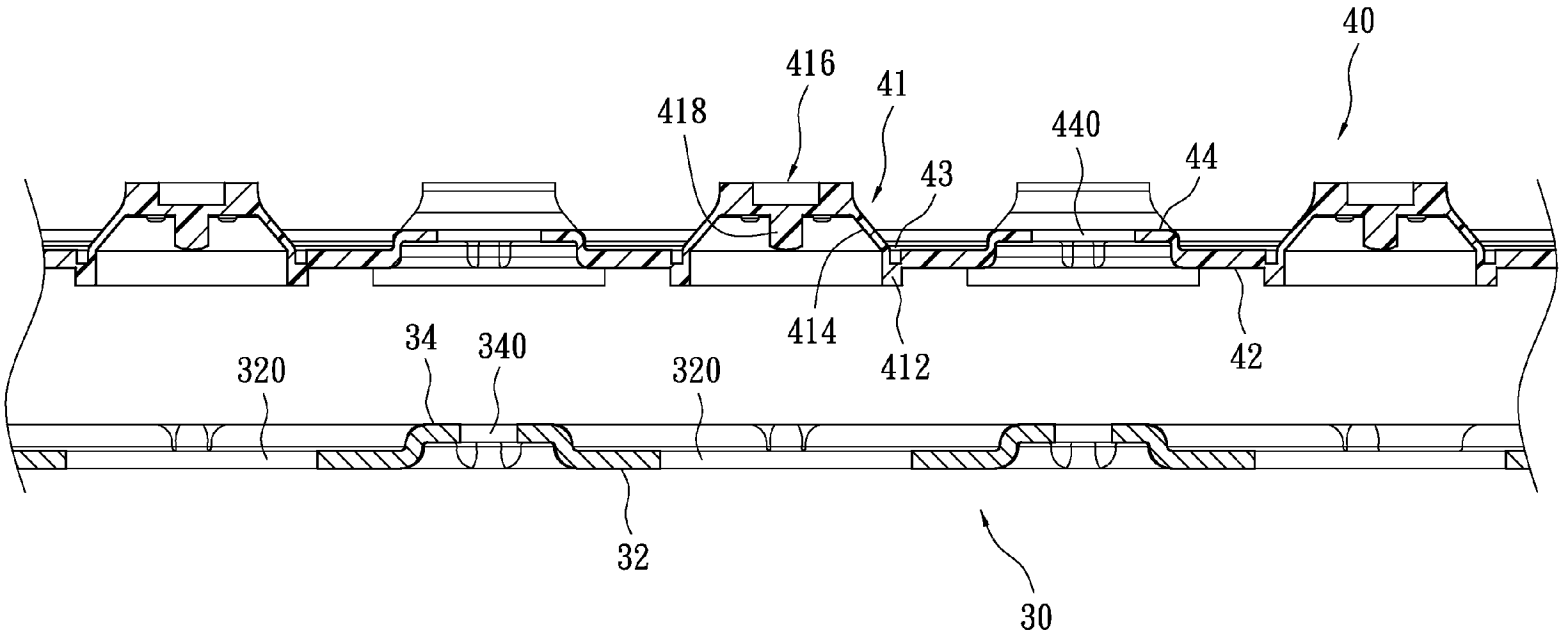
FIG. 1A is a cross-sectional view of a pressure plate and an elastomer member taken along line A-A of FIG. 1.

Please refer to FIG. 1A, which is a cross-sectional view of the pressure plate and the elastomer member taken along line A-A of FIG. 1. The pressure plate 30 is made of rigid material and can be constructed of different materials according to the requirement of rigidness, such as plastic or metallic plate, for structural reinforcement. The pressure plate 30 has a main body 32 and a plurality of ridges 34 protruding upwardly from the main body 32 in a grid-like pattern. The main body 32 is formed with a plurality of openings 320. The openings 320 are surrounded and separated by the ridges 34 individually.

The elastomer member 40 is made of elastic material, such as rubber. The elastomer member 40 includes a plurality of switch domes 41, a base layer 42 extends from the periphery of the switch domes 41 at a predetermined distance from a bottom edge thereof, and a plurality of raised portions 44 protruded upwardly from the base layer 42 in grid-like pattern. The switch domes 41 are disposed in the respective openings 320 of the pressure plate 30. The base layer 42 is disposed on the main body 32 of the pressure plate 30, and the raised portions 44 are disposed on the respective ridges 34. Each of the switch domes 41 has a hollow-ring shaped bottom portion 412, a cone-shaped middle portion 414, and a top portion 416. The top portion 416 has an actuating part 418 formed on a bottom surface thereof to press against the circuit membrane 20. The bottom portions 412 of the switch domes 41 are disposed in the respective openings 320. In this embodiment, the elastomer member 40 further has a plurality of buffering grooves 43 surrounding the respective switch domes 41. Whereas each buffering groove 43 is arranged between the respective switch dome 41 and the base layer 42, and also contiguous to the switch dome respectively. When the switch dome 41 is pressed, the buffering groove 43 provides a plenty space allowed the switch dome 41 to be deformed. Therefore, the buffering grooves 43 can help to facilitate the movement of the switch domes 41.

Please refer back to FIGS. 1 and 2. The upper housing 50 defines a plurality of recesses 52 arranged in a grid-like pattern. Each of the recesses 52 is defined by a bottom wall 522 (as shown in FIG. 2) and a plurality of side walls 521. The side walls 521 are arranged in a grid-like pattern to match substantially with the raised portions 44 of the elastomer member 40. As shown in FIG. 2, the upper housing 50 has a plurality of pressing ribs 526 protruding downwardly from the underside of the bottom wall 522 and under the side walls 521. The pressing ribs 526 are abutted against the raised portions 44. The positions of the pressing ribs 526 substantially match with that of the raised portions 44.

As shown in FIG. 1, each of the recesses 52 has a guiding tube 54 formed on and penetrating the bottom wall 522. The guiding tube 54 is hollow and projects upwardly like a smokestack for guiding the key caps 60, 60'. As shown in FIG. 2, each guiding tube 54 has a ring-shaped bottom edge 542 extends beyond the bottom surface of the bottom wall 522 to press against the base layer 42 and is arranged adjacent to the periphery of the respective switch dome 41. More specifically, the bottom edge 542 of each guiding tube 54 is disposed on the base layer 42 and surrounds the respective buffering groove 43 and the respective switch dome 41. As can be seen from FIG. 3B, for the illustrated embodiment, the inner diameter of the bottom edge 542 of each guiding tube 54 substantially equals to the diameter of the openings 320 of the pressure plate 40.

As previously mentioned, the raised portions 44 of the elastomer member 40 are disposed on the respective ridges 34 of the pressure plate 30. It should be noted that the ridges 34 of the pressure plate 30 and the raised portions 44 of the elastomer member 40 are orderly arranged underneath the upper housing 50 (more details will be provided hereinafter). Therefore, the pressure plate 30 can uniformly support the elastomer member 40. Comparing with a conventional waterproof keyboard, the periphery of the conventional elastomer mat is not well fixed. The present invention utilizes the rigid pressure plate 30 and the elastomer member 40 to function cooperatively with each other. The bottom surface of the elastomer member 40 is propped upwardly toward the upper housing 50 by the rigid pressure plate 30, such that the top surface and the bottom surface of the elastomer member 40 are tightly secured. Therefore, the present invention can provide good water-proof performance, and ensures good touch feel when stroking the keys because the switch domes 41 of the elastomer member 40 are all well fixed well to rebound smoothly upward. Furthermore, the pressure plate 30 and the elastomer member 40 are formed integrally, which can raise the manufacturing efficiency during the assembling process.

Please refer to FIGS. 1A and 2. The way of fixing the pressure plate 30 and the elastomer member 40 to the upper housing 50 is explained herein below. The raised portions 44 are formed with a plurality of upper fixing apertures 440. The ridges 34 are formed with a plurality of lower fixing apertures 340 aligned to the respective upper fixing apertures 440. In this embodiment, the upper fixing apertures 440 are located at the intersections of the raised portions 44. Likewise the lower fixing apertures 340 are located at the intersections of the ridges 34. The upper housing 50 has a plurality of hollow fixing posts 56, which are arranged according to the positions of the upper and lower fixing apertures 440, 340. The fixing posts 56 are located at the intersections of the side walls 521. For the illustrated embodiment, screws (not shown) can be passed upwardly through the lower and upper fixing apertures 340, 440 and secured to the fixing posts 56, such that the elastomer member 40 and the pressure plate 30 are fixed on the bottom surface of the upper housing 50. The elastomer member 40 is sandwiched in between the upper housing 50 and the pressure plate 30, where the top and bottom surfaces of the elastomer member 40 are tightly pressed against the upper housing 50 and the pressure plate 30, respectively. Therefore, good waterproof function is provided.

The fixing elements according to the above described fixing means include the fixing posts 56 protruded downwardly from the bottom wall of the upper housing 50 and screws (not shown). However, the fixing elements are not limited thereto. For example, the fixing posts 56 protruded from the bottom surface of the upper housing 50 can be a hot-melt structure. Alternatively, ultrasonic welding technology can be utilized to join the parts together. Still yet another way is available. The lower fixing apertures 340 of the pressure plate 30 can be replaced with similar fixing posts, which can be wedged into the fixing posts 56. This particular method does not need to form holes on the pressure plate 30 either.

Please refer to FIGS. 1 and 2. Generally speaking, for standard sized keys, each key cap 60 has a key stem 64 formed on a bottom side thereof. The key stem 64 passes through the guiding tube 54 and is guided to make contact with the respective switch dome 41. Each key stem 64 has at least one hook 642. Each guiding tube 54 is formed with a hooking hole 540 to restrict the displacement of the hook 642, therefore the key cap 60 is guided and restricted in the guiding tube 54. The above configuration can also be applied to a larger key cap 60', such as the Enter key. Refer to FIG. 1, a recess 52' is defined by the upper housing 50 to receive the key cap 60'. The recess 52' further defines a pair of guiding holes 520 disposed oppositely and adjacently to the guiding tube 54. The key cap 60' has a pair of balance pieces 66 (as shown in FIG. 2) formed on a bottom surface thereof passing through the guiding holes 520. Refer to FIG. 1, the elastomer member 40 further has a base layer 42' positioned matchingly to the key cap 60'. The base layer 42' is further formed with a pair of concaved portions 422 for receiving the balance pieces 66. The concaved portions 422 do not penetrate through the base layer 42'. The pressure plate 30 further has a main body 32' that is formed with a pair of through holes 322 for engagement with the concaved portions 422.

Please refer back to FIG. 1. In this embodiment, the lower housing 10 has a plurality of circular-shaped supporting rings **14*b* protruding from a top surface thereof under the respective switch domes 41. Thus, the conductive areas of the circuit membrane 20 and the switch domes 41 are propped up by the respective supporting rings 14*b*. Such configuration enhances the touch feel when depressing the keys. Further, the lower housing 10 in this embodiment can further has a plurality of supporting ribs 14*a* crisscrossing the supporting rings 14*b***.

The supporting ribs 14*a* are arranged in a grid-like pattern to prop up and support the circuit membrane 20. However, the shape and structure of the supporting ring and the supporting rib are not limited thereto, and to support the switch domes 41 and base layer 42 is suitable.

Figure 3A:
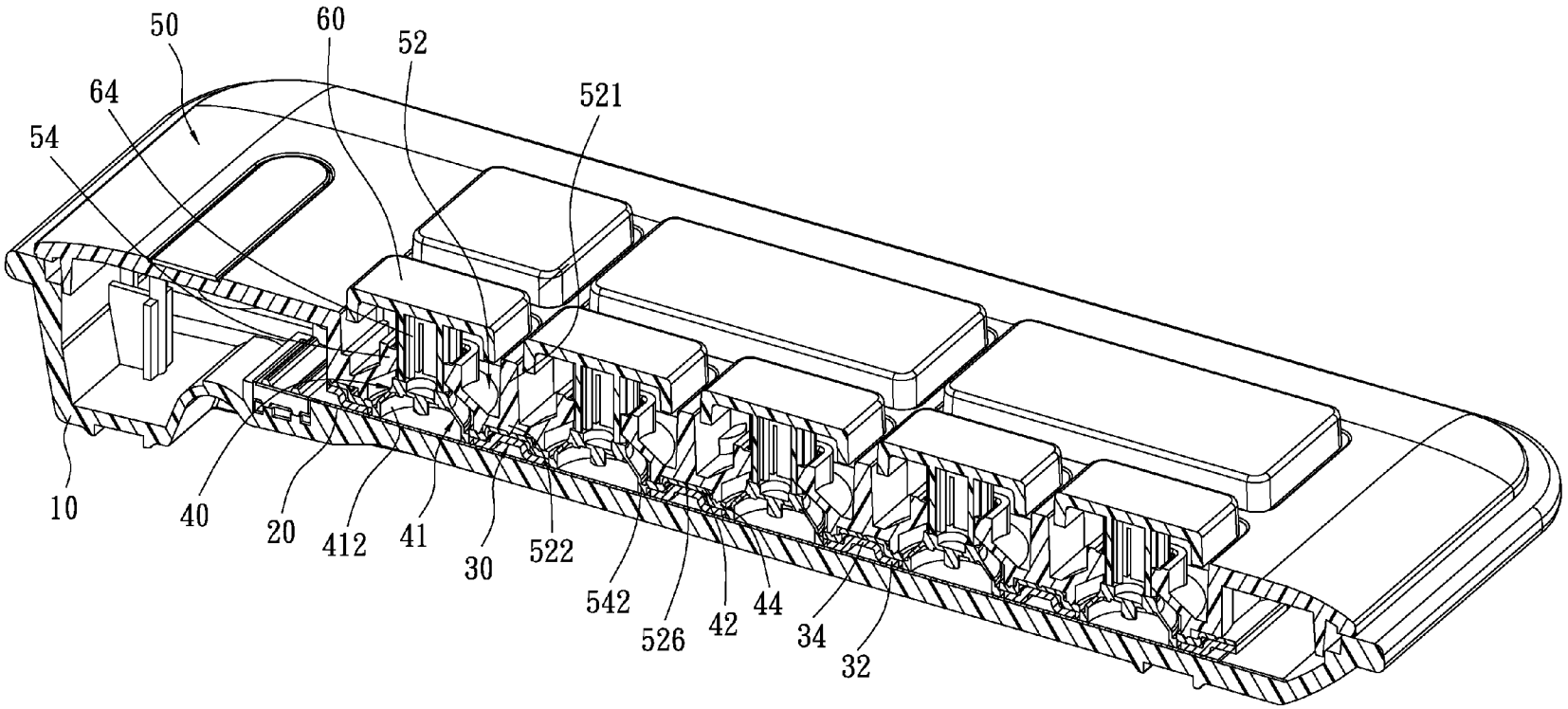
FIG. 3A is a cross-sectional view of the waterproof keyboard taken along line B-B of FIG. 3.
Figure 3B:
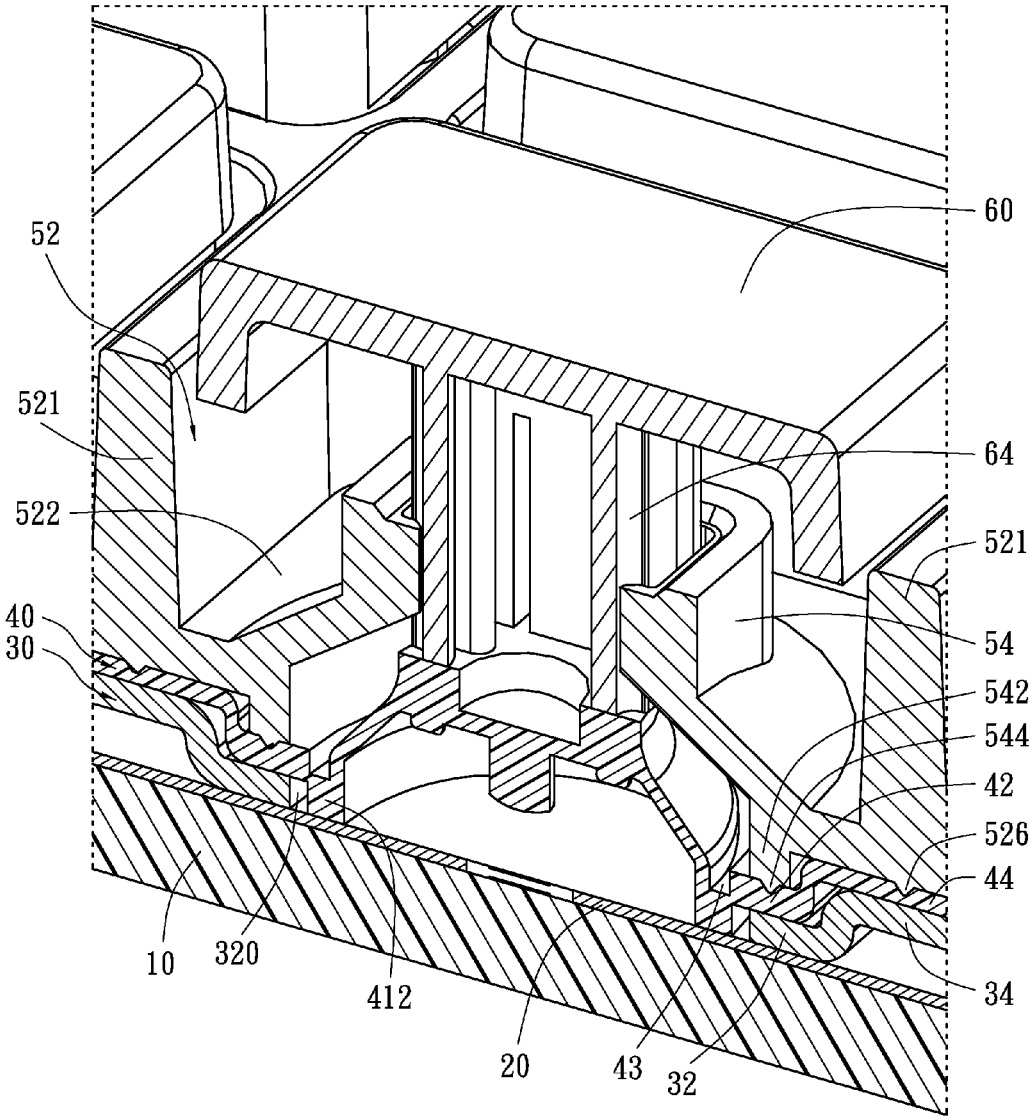
FIG. 3B is a partial enlarged view of FIG. 3A.

Please refer to FIGS. 3A and 3B, which are a cross-sectional view taken along line B-B of FIG. 3 and a partial enlarged cross-sectional view of FIG. 3A of the present invention, respectively. Because the bottom edge 542 of the guiding tube 54 circularly presses against the base layer 42 around the switch domes 41, accidental-splashed liquid will be limited in the recess 52 or the guiding tube 54 and will not overflow outwardly along the elastomer member 40. Besides, the pressure plate 30 upwardly and tightly props up the elastomer member 40, so that it can provide well waterproof performance. As shown in FIG. 3B, the bottom edge 542 of the guiding tube 54 is preferably protruded with a prism-shaped retaining rib 544. The retaining rib 544 is disposed circumferentially on the bottom edge 542 of the guiding tube 54. The retaining rib 544 can cooperate with the main body 32 of the pressure plate 30 to tightly sandwich the base layer 42 of the elastomer member 40.

Further, a pressing ribs 526, which are formed on the bottom edge of the side walls 521 and positioned matchingly to the raised portions 44 with a cross-section that is substantially prism-shaped, can cooperate with the ridges 34 of the pressure plate 30 to tightly sandwich the raised portions 44 of the elastomer member 40, so that liquid can be kept form entering the keyboard. The waterproof structure of the present invention even can achieve a waterproof grade of SP6 through testing.

The present invention not only has good waterproof performance, but also provides good operating/touch feel. As shown in FIG. 3B, the bottom edge 542 of each guiding tube 54 works cooperatively with the main body 32 of the pressure plate 30 to position around the respective switch dome 41 and adjacent to the neighboring buffering groove 43, such that the buffering grooves 43 around the switch domes 41 can provide the switch domes 41 with sufficient rooms while being depressed. Therefore, the switch domes 41 can maintain proper working actions. Such structural features of the present invention can provide the key cap 60, 60' with a good rebounding action after being pressed and a good touch feel.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A waterproof keyboard, comprising:

a lower housing;

a circuit membrane disposed on the lower housing;

a pressure plate disposed on the circuit membrane, the pressure plate having a main body and a plurality of ridges protruded therefrom upwardly in a grid-like pattern, the main body having a plurality of openings, wherein the openings are surrounded independently and separated by the ridges;

an elastomer member including a plurality of switch domes disposed in the respective openings, a base layer extending from the periphery of the switch domes at a predetermined distance from a bottom edge thereof, and a plurality of raised portions protruded upwardly from the base layer in grid-like pattern, wherein the base layer is disposed on the main body of the pressure plate, and the raised portions are disposed on the respective ridges;

an upper housing having a plurality of guiding tubes disposed on the elastomer member; and a plurality of key caps, each key cap having a key stem formed on a bottom surface thereof, with each key stem passing through the respective guiding tube and abutting the respective switch dome;

wherein the raised portions of the elastomer member and the ridges of the pressure plate are orderly arranged and fixed to a bottom surface of the upper housing, and the ridges are abutted against the underside of respective raised portions, wherein the elastomer member is disposed between the pressure plate and the upper housing.

2. The waterproof keyboard as claimed in claim 1, wherein the upper housing defines a plurality of recesses, each of the recesses is defined by a bottom wall and a plurality of side walls, wherein the guiding tube is formed penetratingly through the bottom wall, and wherein the side walls are arranged into a grid-like pattern and abutted by the raised portions of the elastomer member.

3. The waterproof keyboard as claimed in claim 2, wherein the upper housing has a plurality of pressing ribs protruded downwardly from an underside of the bottom wall and under the side walls, and wherein the pressing ribs are pressed against the raised portions.

4. The waterproof keyboard as claimed in claim 2, wherein each of the guiding tubes has a bottom edge extended past the bottom walls and pressing against the base layer around the switch domes correspondingly.

5. The waterproof keyboard as claimed in claim 4, wherein each guiding tube further includes a substantially prism-shaped retaining rib protruded circumferentially from the bottom edge thereof.

6. The waterproof keyboard as claimed in claim 4, wherein the bottom edge of each guiding tube defines an inner diameter that is substantially the same as that of the respective opening of the pressure plate.

7. The waterproof keyboard as claimed in claim 4, wherein the elastomer member further defines a plurality of buffering grooves surrounding the switch domes respectively and arranged between the respective switch domes and the base layer, and wherein the bottom edges of the guiding tubes are disposed adjacently to the buffering grooves correspondingly.

8. The waterproof keyboard as claimed in claim 2, wherein one of the recesses further defines a pair of guiding holes oppositely spaced from the guiding tube, and wherein one of the key caps has a pair of balance pieces formed on a bottom surface thereof passing through the guiding holes.

9. The waterproof keyboard as claimed in claim 8, wherein the base layer of the elastomer member is formed with a pair of concaved portions for receiving the balance pieces, and wherein the pressure plate is formed with a pair of through holes to accommodate the concaved portions.

10. The waterproof keyboard as claimed in claim 2, wherein the upper housing has a plurality of fixing posts disposed at intersections of the side walls.

11. The waterproof keyboard as claimed in claim 1, wherein the upper housing has a plurality of fixing elements protruded downwardly from a bottom wall thereof, wherein the raised portions form a plurality of upper fixing apertures, and the ridges define a plurality of lower fixing apertures in alignment with the upper fixing apertures, and wherein the fixing elements pass through the respective upper and lower fixing apertures to sandwich the elastomer member between the upper housing and the pressure plate.

12. The waterproof keyboard as claimed in claim 11, wherein each of the fixing elements includes a fixing post protruded from the bottom wall of the upper housing and a screw.

13. The waterproof keyboard as claimed in claim 11, wherein the upper fixing apertures are formed at intersections of the raised portions, and wherein the lower fixing apertures are formed at intersections of the ridges.

14. The waterproof keyboard as claimed in claim 1, wherein the lower housing is protruded with a plurality of supporting rings from a top surface thereof and wherein the supporting rings are arranged under the switch domes correspondingly.

15. The waterproof keyboard as claimed in claim 14, wherein the lower housing further includes a plurality of supporting ribs formed on the top surface thereof crisscrossing the supporting rings.

16. The waterproof keyboard as claimed in claim 1, wherein the pressure plate is made of a rigid material.

17. The waterproof keyboard as claimed in claim 1, wherein each key stem has at least one hook, and each guiding tube is formed with a hooking hole to restrict the displacement of the hook.

* * * * *